US007195321B1

(12) United States Patent
Sollami

(10) Patent No.: US 7,195,321 B1
(45) Date of Patent: Mar. 27, 2007

(54) WEAR RING FOR A ROTATABLE TOOL

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 11/416,695

(22) Filed: May 3, 2006

Related U.S. Application Data

(63) Continuation-in-part of application No. 11/013,000, filed on Dec. 15, 2004, now abandoned.

(51) Int. Cl.
*E21C 35/18* (2006.01)

(52) U.S. Cl. ..... 299/104; 299/107

(58) Field of Classification Search ..... 299/104, 299/107
See application file for complete search history.

(56) References Cited

U.S. PATENT DOCUMENTS 3,342,531 A * 9/1967 Krekeler ..... 299/107
4,818,027 A * 4/1989 Simon ..... 299/107
5,931,542 A * 8/1999 Britzke et al. ..... 299/104
2004/0004389 A1* 1/2004 Latham ..... 299/104

FOREIGN PATENT DOCUMENTS

DE 10110015 A1 * 10/2002

* cited by examiner

*Primary Examiner*—John Kreck
(74) *Attorney, Agent, or Firm*—Robert L. Marsh

(57) ABSTRACT

A tool has a tapered forward cutting end behind which is a cylindrical shank. A rearwardly facing annular flange separates the forward cutting end from the shank. The shank is received in a tool holder having a planar forward surface, and fitted around the shank of the tool and resting on the forward surface of the tool holder is an annular wear ring. The wear ring has a small outer diameter portion that is less than the outer diameter of the radial flange and less than the diameter of the forward end of the tool holder, thereby allowing a gap between those parts to receive an extraction tool. The wear ring also has a large outer diameter portion at least equal to the diameter of the forward surface of the tool holder.

9 Claims, 8 Drawing Sheets

WEAR RING FOR A ROTATABLE TOOL

The present application is a Continuation-in-Part of my application entitled Extraction Device and Wear Ring for a Rotatable Tool filed Dec. 15, 2004 and assigned Ser. No. 11/013,000 now abandoned. The present invention relates to rotatable tools used in machines to cut hard surfaces and to an improved wear ring between the tool and the tool holder adapted to receive an extraction device for extracting the tool from the tool holder.

BACKGROUND OF THE INVENTION

Machines for cutting hard surfaces such as used in the trenching and mining industries and for highway cold planning to remove the upper surface of concrete and asphalt pavement, employ tools fitted into tool holders on a rotatable wheel or drum. The tools have a tapered forward cutting end and axially behind the cutting end is a cylindrical shank that rotatably fits within a complementarily shaped bore in the tool holder. Such rotatable tools have an annular rearwardly directed flange between the forward cutting end and the shank that contacts the forward surface of the tool holder. The shank is retained in the bore of the tool holder by a sleeve made of spring steel so as to be compressible and has an unstressed diameter greater than that of the bore, such that compression of the sleeve retains the sleeve within the bore of the tool holder. To prevent the withdrawal of the tool from the tool holder, the sleeve has one or more inwardly directed projections in the inner surface that engage an annular shoulder around the circumference of the shank of the tool.

To maximize the useful life of such tools, the tools are adapted to rotate around the axis of the shank thereby causing the tool to wear evenly about its circumference. A tool in a machine may undergo 50,000 rotations or more during a single work day, and the rotation of the rearwardly directed flange against the forward surface of the tool holder will over time cause the forward surface of the tool holder to become worn away. To prevent such wear, it is common to provide an annular wear ring around the shank of the tool between the forward surface of the tool holder and the rearwardly directed flange of the tool.

Ojanen U.S. Pat. No. 6,478,383 B1 discloses a rotatable cutting tool having a tapered forward end with a rearwardly facing annular flange and a rearwardly extending shank that fits into a tool holder and a wear ring positioned on the shank of the tool behind the radial flange and against the forward surface of the tool holder. The wear ring of Ojanen has a circular outer circumference with a diameter that is less than the diameter of the radial flange of the tool and less than the diameter of the forward surface of the tool holder such that a gap exists between the rearward surface of the flange and the forward surface of the tool holder. Ojanen suggests that the portion of the radial flange that overhangs beyond the diameter of the wear ring can be used to receive an extraction tool for removing the rotatable tool from the tool holder. The tool assembly disclosed by the Ojanen patent, however, has certain disadvantages. First, the Ojanen wear ring is not locked against rotation with the tool and consequently the wear ring rotates, at least to some degree, with the tool. As the wear ring rotates against the forward surface of the tool holder it wears away the portion of the forward surface of the tool holder behind the wear ring. The tools of such machines are frequently replaced because they become rapidly worn, and as the machine is used, the wear from the rotating wear rings create a countersink that becomes deeper with each replaced tool. Eventually, the countersink in the forward surface of the tool holder becomes deep enough that the rearward surface of the flange of the tool will make contact with the forward surface of the tool holder thereby defeating the primary purpose for installing the wear ring. The secondary purpose of the Ojanen wear ring is to facilitate the removal of the tool and that purpose is also defeated as the rearward surface of the wear ring wears away the forward surface of the tool holder because the gap between the rearward surface of the radial flange and the forward surface of the tool holder is gradually reduced.

Briske U.S. Pat. No. 5,931,542 discloses a rotatable tool having a tapered forward cutting end and a cylindrical rearwardly extending shank that is received in a cylindrical aperture of a tool holder and a wear ring between the rearward flange of the tool and the forward surface of the tool holder with the wear ring locked against rotation with the tool. The outer shape of the wear ring is circular and the outer diameter of the wear ring is approximately equal to the diameter of the radial flange of the tool and approximately the same diameter of the forward surface of the tool holder. The wear ring of Briske, therefore, does not aid in the removal of the tool from the tool holder.

I have found that a circular wear ring having a diameter less than the outer dimensions of the forward surface of the tool holder will fail to perform its intended function even where the wear ring is locked against rotation with the tool. To cut hard surfaces, such tools require that a great amount of force be applied from the forward surface of the tool holder against the rear flange of the tool. All the force applied by the cutting tool is therefore applied through the wear ring. Where the wear ring has a small diameter circular periphery, the forward surface of the tool holder becomes indented under the wear ring even though the wear ring is locked against rotation. Over a period of time, the forward end of the tool holder becomes more deeply indented thereby gradually eliminating the gap between the rearward flange of the tool and the forward surface of the tool holder. Eventually, the gap is insufficient to receive an extraction tool for removing the rotatable tool from the tool holder. Ultimately, the indentation becomes so severe that the rearward surface of the radial flange contacts the forward surface of the tool holder and the purpose of the wear ring is again defeated.

To operate properly, the wear ring must remain stationary against the forward surface of the tool holder while the tool rotates. A tool holder that receives tools with wear rings that do not rotate will have four times the useful life of a tool holder receiving tools with wear rings that are not locked against rotation with the tool. Of course, over time, even a tool holder with a non-rotating wear ring must be replaced because the tool rotates within the tool holder and, along with rotating, the tool is subjected to heavy forces. Gradually, the forward surface of the tool holder becomes worn and the retaining bore of the holder enlarges in diameter. Replacement eventually becomes necessary.

In my co-pending application filed Sep. 28, 2004 and issued Ser. No. 10/952,158, I disclose a wear ring having an inwardly directed projection on the inner opening thereof that will engage portions of the upper end of the compressible sleeve to prevent the wear ring from rotating with respect to the tool holder while the tool is in use. In the same application I disclose that an enlarged diameter of the wear ring can be used to facilitate the extraction of the tool from the tool holder. There are circumstances, however, when it is not desirable to have a wear ring, the outer diameter of which is larger than the diameter of the radial flange of the tool. In such circumstances, it is desirable to provide an alternative method of extracting the tool from the tool holder.

SUMMARY OF THE INVENTION

Briefly, in the present invention a tool is provided having a tapered forward cutting end with a hardened tip at the forward end thereof. At the rearward end of the forward cutting end is a rearwardly facing annular flange having a flange diameter, and extending axially from the rearwardly directed annular flange is a cylindrical shank. Fitted around the cylindrical shank is a compressible sleeve for retaining the shank of the tool in the tool holder.

The tool holder for receiving the shank of the tool has a generally planar forward surface and centrally located in the forward surface is a perpendicularly oriented bore. The outer surface of the tool holder in the proximity of the forward surface is generally frustoconical and the distance between opposing portions of the intersection of the forward surface with the frustoconical side surface defines a forward surface diameter.

A wear ring for use with the tool has planar forward and rearward surfaces and an inner opening sized to receive the shank of the tool. The periphery of the wear ring is noncircular having a first peripheral dimension that is smaller than a second peripheral dimension. The first peripheral dimension is less than both flange diameter and the forward surface diameter. Accordingly, when the wear ring spaces the flanges of a tool from the forward surface of a tool holder, a gap exists between the rearwardly directed radial flange of the tool and the forward surface of the tool holder in the proximity of the first peripheral dimension.

An extraction tool having a pair of parallel members spaced apart a distance a little greater than the first peripheral dimension can be positioned in the gaps between the rearwardly directed flange and the forward surface and a hammer or the like can be used to pound against a surface of the extraction tool to thereby remove the rotatable tool from the tool holder.

The second periphery dimension of the wear ring is at least equal to the forward surface diameter, that is, at least equal to an outer dimension of the forward surface of the tool holder. Accordingly, a portion of the wear ring extends to the outer dimension of the forward surface of the tool holder and the portion of the outer surface below the wear ring receives the same degree of indentation as the central portion of the forward surface. When the tool and wear ring are subsequently replaced, a new wear ring will have a somewhat different orientation than the first wear ring, and the larger dimension portion of the new wear ring will extend across a different portion of the forward surface of the tool holder than did the first one. The forward surface will therefore not become indented over time.

BRIEF DESCRIPTION OF THE DRAWINGS

A better understanding of the present invention will be had after a reading of the following detailed description taken in conjunction with the drawings wherein.

DETAILED DESCRIPTION OF PREFERRED EMBODIMENT

Figure 13:
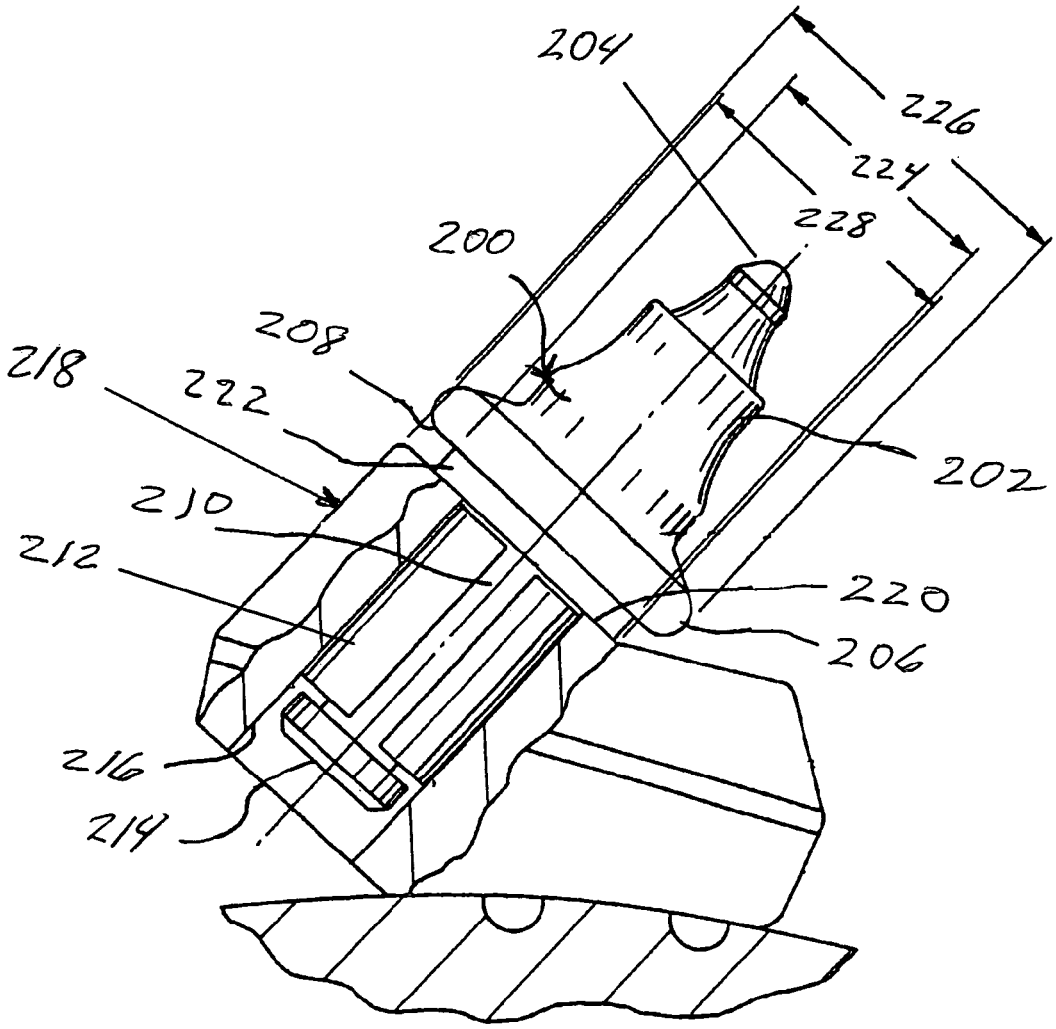
FIG. 13 PRIOR ART
FIG. 13 is a cross-sectional view of a tool, tool holder, and a small diameter wear ring in accordance with the prior art.

Referring to FIG. 13, a cutting tool 200 in accordance with the prior art has a tapered forward cutting end 202 having a cutting tip 204 at one end and the opposite end of which diverges outward to a maximum diameter portion 206. Rearward of the maximum diameter portion 206 is an annular radial flange 208, and extending rearwardly from the center of the annular radial flange 208 is a cylindrical shank 210. A collapsible retaining ring 212 is retained on the radial shank 210 by an enlarged diameter hub 214 at the distal end thereof.

The cylindrical shank 210 is received in a tubular bore 216 of a tool holder 218 having a generally planar forward surface 220 that is parallel to the plane defined by the annular radial flange 208. Fitted between the radial flange 208 and the forward surface 220 is a wear ring 222 in accordance with the prior art having a planar forward surface that engages the radial flange 208, and a rearward surface that engages the forward surface 220 of the tool holder 218. The wear ring 222 has a circular outer circumference having a diameter 224 that is less than the diameter 226 of the radial flange 208 and less than the diameter 228 of the forward surface 220.

Figure 14:
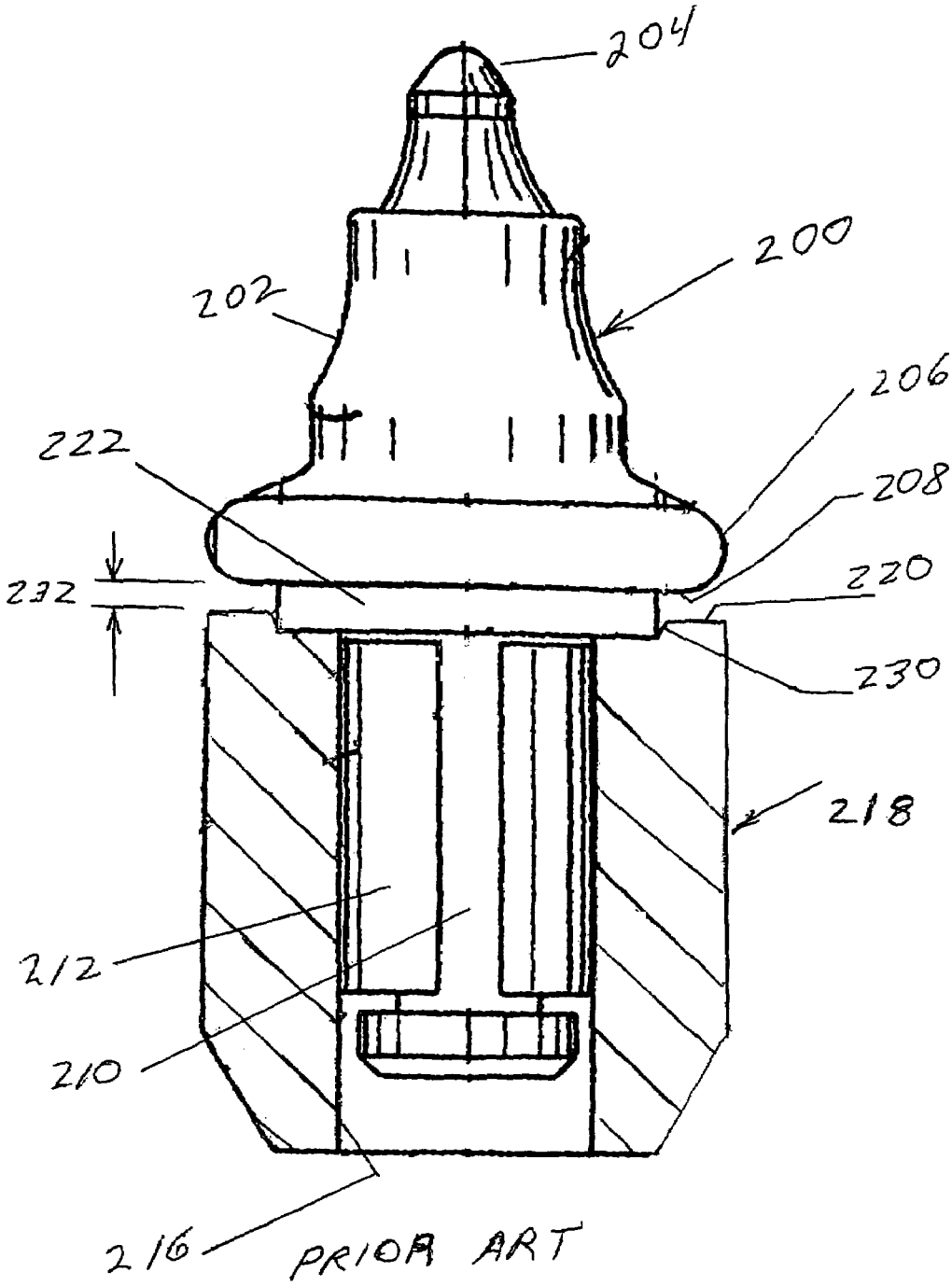
PRIOR ART FIG 14
FIG. 14 is a fragmentary enlarged cross-sectional view showing the distortion of the forward surface of the tool holder resulting from the use of the small diameter wear ring shown in FIG. 13.

As best shown in FIG. 14, the force applied by the cutting tool 200 to a hard surface is applied to the portion of the forward surface 220 of the tool holder 218 that is immediately behind the wear ring 222 causing the forward surface 220 to undergo an indentation 230 over a period of time. The forward surface 220 becomes indented regardless of whether or not the wear ring 222 rotates with the tool 200, and over a period of time the spacing 232 between the rearward surface of the flange 208 and the forward surface 220 of the tool holder 218 becomes reduced. Where it is intended to insert an extraction tool in the spacing 232 to extract the tool 200 from the tool holder 218, the reduction of the spacing 232 inhibits the insertion of an extraction tool. Eventually, the spacing 232 will become so narrow that an extraction tool cannot be inserted between the parts. In time the spacing 232 will vanish and the rearward surface of the annular flange 208 will rotate directly against the forward surface 220 of the tool holder causing the forward surface of the tool holder to become worn. When this occurs, the purpose for installing the wear ring 222 has been totally defeated.

Figure 1:
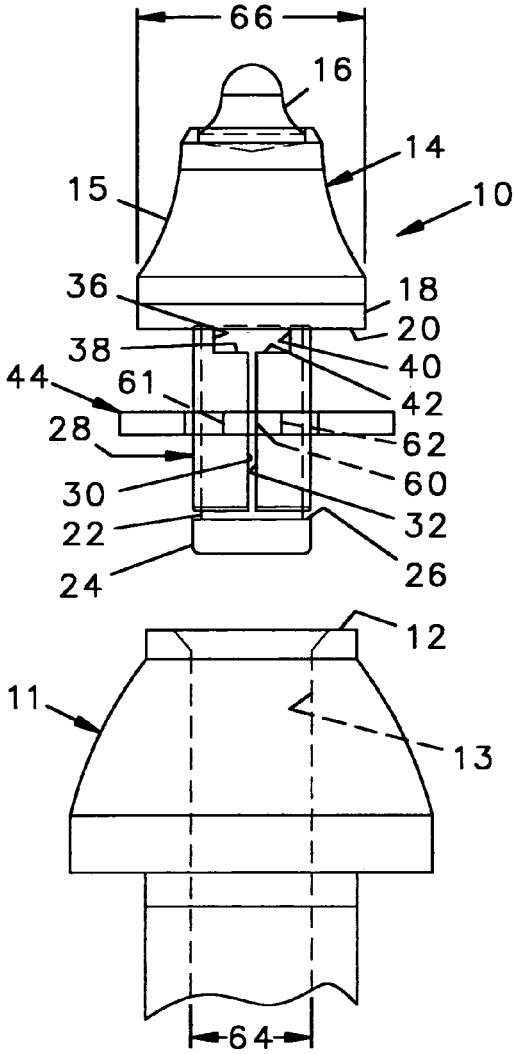
FIG. 1 is an exploded side view of a tool and tool holder having a wear ring in accordance with the invention, with the inner portions of the parts shown in broken lines.
Figure 2:
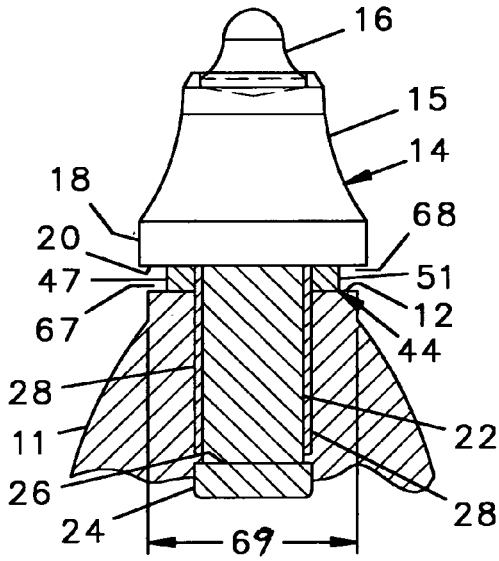
FIG. 2 is a side-elevational view, taken partly in cross-section, of the tool, tool holder, and wear ring depicted in FIG. 1 in assembled form.

Referring to FIGS. 1 and 2, a tool 10 is suitable for being rotatably mounted in a tool holder 11 having a planar forward surface 12 and a bore 13, the axis of which is perpendicular to the forward surface 12. The tool holder 11 may be mounted directly to the drum or wheel of the machine or may be a quick-change holder as depicted. The tool 10 includes a tool body 14 having a tapered forward cutting portion 15 at the forward end of which is a seat into which is brazed a hardened cutting tip 16. The cutting portion 15 flares outwardly near its rearward end to a flange 18 having a generally planar annular rearward surface 20. Extending axially rearwardly from the center of the annular rearward surface 20 is a cylindrical shank 22 having an enlarged hub 24 at the distal end thereof. The hub 24 forms a shoulder 26, and fitted forwardly of the shoulder 26 is a compressible sleeve 28 made of a suitable spring steel.

The compressible sleeve 28 generally defines a hollow cylinder with an elongate slot extending axially in the length of the wall forming parallel spaced slot edges 30, 32. The sleeve 28 is of the type disclosed in my co-pending application Ser. No. 10/952,158 and has at the forward end of the sleeve 28 adjacent slot edge 30, a cut out portion defined by an axial wall 36, and an arcuate wall 38. Similarly, at the forward end of the second slot edge 32 is a second cut out portion defined by an axial wall 40 and an arcuate wall 42.

Referring to FIGS. 1 through 5, fitted around the compressible sleeve 28 is a wear ring 44 having a planar forward surface 45, a parallel planar rearward surface 46, and outer surfaces 47, 48, 49, 50, 51, 52, 53, 54. Surfaces 47 and 51 are both planar and parallel to one another and are located on opposing portions of the wear ring 44. Surfaces 49 and 53 are also planar and parallel to each other, are located on opposing portions of the wear ring 44, and are perpendicular to surfaces 47 and 51. Surfaces 48, 50, 52, 54 are all arcuate and preferably form arcuate sections of the same cylinder.

The wear ring 44 also has a central opening including a semi-cylindrical portion 56 that defines approximately 300 degrees of a circle, and at the ends of the semi-cylindrical portion 56 are radially outwardly extending notches 57, 58. Between the notches 57, 58 is a radially inwardly extending arcuate portion 60 having sides 61 and 62. The inner surface of the arcuate portion 60 defines a cylinder having a center co-axial with the center of the semi-cylindrical portion 54 but having a radius R1 that is substantially less than the radius R2 of the semi-cylindrical portion 56. The diameter of the opening defined by semi-cylindrical portion 56 is greater than the diameter 64 of the tool holder 11.

Figure 3:
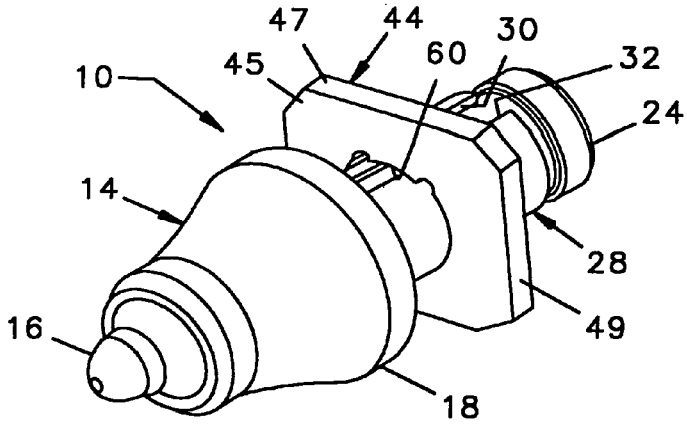
FIG. 3 is an isometric view of the tool and wear ring shown in FIGS. 1 and 2 prior to the tool being inserted into the tool holder.

As shown in FIG. 3, prior to insertion of the shank 22 of the tool 10 into a bore 13 of a tool holder 11, the wear ring 44 is fitted around the central portion of the circumference of the sleeve 28 with the arcuate portion 60 extending across the edges 30, 32 of the slot therein.

Figure 4:
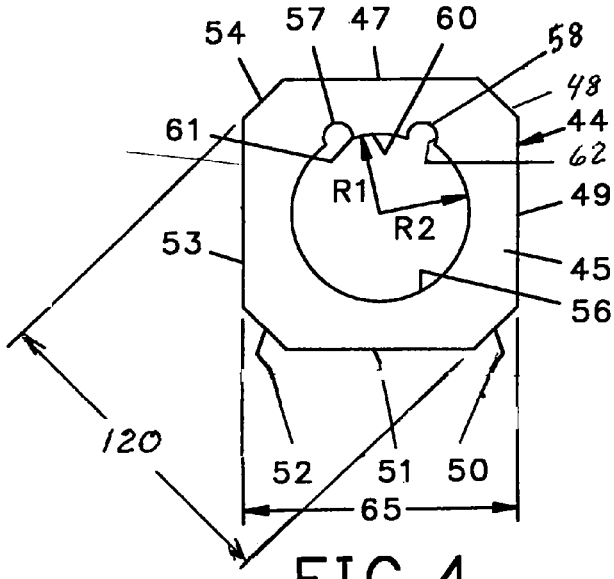
FIG. 4 is a front-elevational view of the wear ring shown in FIGS. 1 through 3.
Figure 5:
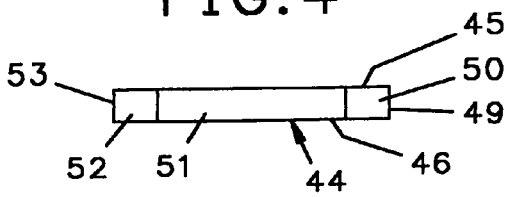
FIG. 5 is a side-elevational view of the wear ring shown in FIG. 4.

Referring specifically to FIGS. 1, 3, and 4, and as disclosed in my co-pending application Ser. No. 10/952,158, the inwardly directed protrusion of the arcuate portion 60 compresses the sleeve 28 to a diameter that is less than the inner diameter of the bore 13 of the tool holder 11. The distal end of the shank 22 of the tool 10, including a portion of the sleeve 28 can then be manually inserted by a machine operator into the bore 13 using only one hand. The machine operator will be able to insert the distal end of the shank 22 until the rearward surface 46 of the wear ring 44 contacts the planar forward surface 12 of the tool holder 11. Thereafter, the cutting tip 16 of the tool 10 is pounded with a hammer to drive the shank 22 with the sleeve 28 thereon into the bore 13 of the holder 11. As the shank 22 is driven into the bore 13 the wear ring 44 is moved forwardly along the sleeve until the arcuate protrusion 60 thereof drops into the cut out portion 36, 38, 40, 42, after which the sleeve 28 can expand to the full diameter of the bore 13 of the tool holder 11.

Referring to FIGS. 1 and 3, the axial walls 36, 40 of the cut out portions at the forward end of the sleeve 28, as it is being compressed by the wear ring 44, are spaced further apart from each other than the width of the arcuate portion 60 of the wear ring 44 as defined by the distance between the sides 61 and 62. Accordingly, when the shank 22 of the tool 10 is driven entirely into the bore 13 of the tool holder 11, the wear ring 44 will be forced to the forward end of the sleeve 28 and the arcuate portion 60 will drop between the axial walls 36, 40 of the compressible sleeve 28. When this occurs, the compressible sleeve 28 will be released from beneath the arcuate portion 60 and allowed to expand. Since the diameter defined by semi-cylindrical portion 56 is larger than the diameter of the inner bore 13 of the tool holder 11, the compressible sleeve will expand until the outer surface thereof contacts the inner surface of the bore 13 of the tool holder 11. The tool 10 will thereafter be retained within the bore 13 of the tool holder 11 by the radially outwardly applied force of the partially compressed sleeve 28. Furthermore, the wear ring 44 will be retained against rotation with respect to the sleeve 28 by the contact of the sides 61, 62 of the arcuate portion 60 against the axial walls 36, 40 of the cut out portions at the forward end of the sleeve 28. Accordingly, the wear ring 44 is prevented from rotating with the tool 10 and will not cause rotational wear to the forward surface 12 of the tool holder 11.

Referring to FIGS. 1, 2, and 4, the distance 65 between the parallel outer surfaces 49, 53 and between parallel surfaces 47, 51 is significantly less than the outer diameter 66 of the radial flange 18 and is also substantially less than the diameter 69 across the forward surface 12 of tool holder 11. As a result, when the wear ring 44 is fitted around the shank 22 between the rearward surface 20 of the flange 18 and the forward surface 12 of the tool holder 11, a pair of opposing gaps 67, 68 are formed adjacent surfaces 47, 51 (best shown in FIG. 2) and similar gaps (not shown) are formed adjacent surfaces 49, 53. Preferably, for tools 10 used in the road planning industry, the rearward surfaces 20 of the tool 10 and the forward surface 12 of the tool holder 11 have diameters of about 1.5 inches, and the distance 65 is generally no greater than 1.25 inches. Preferably, there is between one-eighth inch to one-quarter inch of the width of the rearward surface 20 and on the forward surface 12 of each gap 67, 68 to allow an end extraction tool 70 to be inserted in the gaps 67, 68 between the surfaces 12, 20.

Figure 10:
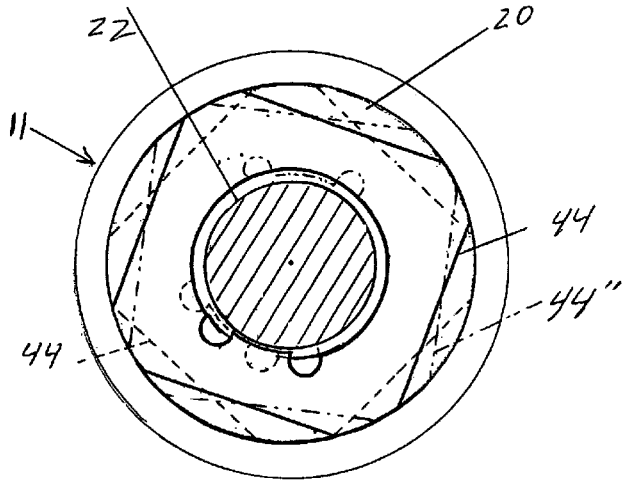
FIG. 10 is an enlarged front elevational view of the forward surface of the tool holder shown in FIG. 1 with a plurality of successively assembled wear rings depicted thereon in broken lines.

Referring to FIGS. 2, 4, and 10, the maximum outer dimension 120 (FIG. 4) of the wear ring 44, as determined by the distance between surfaces 48, 52 or surfaces 50, 54 (FIG. 2) is substantially equal to the maximum diameter 69 of the forward end tool holder 11. As shown in FIG. 10, when the shank 22 of a tool is inserted into a tool holder 11, the outermost portions of the wear ring 44 will rest upon a portion of the outermost perimeter of the forward surface 12 of the tool holder 11. As a result, when force is applied by the forward surface 12 of the tool holder 11 through the wear ring 44 to the rearward surface 20 of the tool 10, the force will be applied across some fraction of the outermost portions of the forward surface 12. Consequently, the force applied by the tool holder 11 through the wear ring 44 will be distributed, at least in part, across the entire maximum diameter of the forward surface of the tool holder 11. When a subsequent tool having a subsequent wear ring 44' is fitted into the tool holder 11, it will be at a somewhat different orientation than the original wear ring 44 and therefore the force will be applied through a somewhat different portion of the entire diameter of the forward surface 12 of the tool holder 11. When yet another substitute tool is inserted into the tool holder 11, the wear ring 44" will be situated in yet another configuration such that a different portion of the forward surface 12 of the tool holder 11 will apply force to the tool 10. Even though the wear ring 44 for each of the successive tools 10 does not rotate within the tool, each successive wear ring 44 is positioned at a different orientation than its predecessor and therefore the forward surface 12 of the tool holder 11 is only nominally indented by the presence of each of the successive wear rings 44. In fact, during normal use, the forward surface 12 will generally be uniformly worn away by movement of the various wear rings 44 and consequently the gaps 67, 68, as depicted in FIG. 2, will not become gradually reduced as the tools 10 are repeatedly replaced in the tool holder 11.

Figure 6:
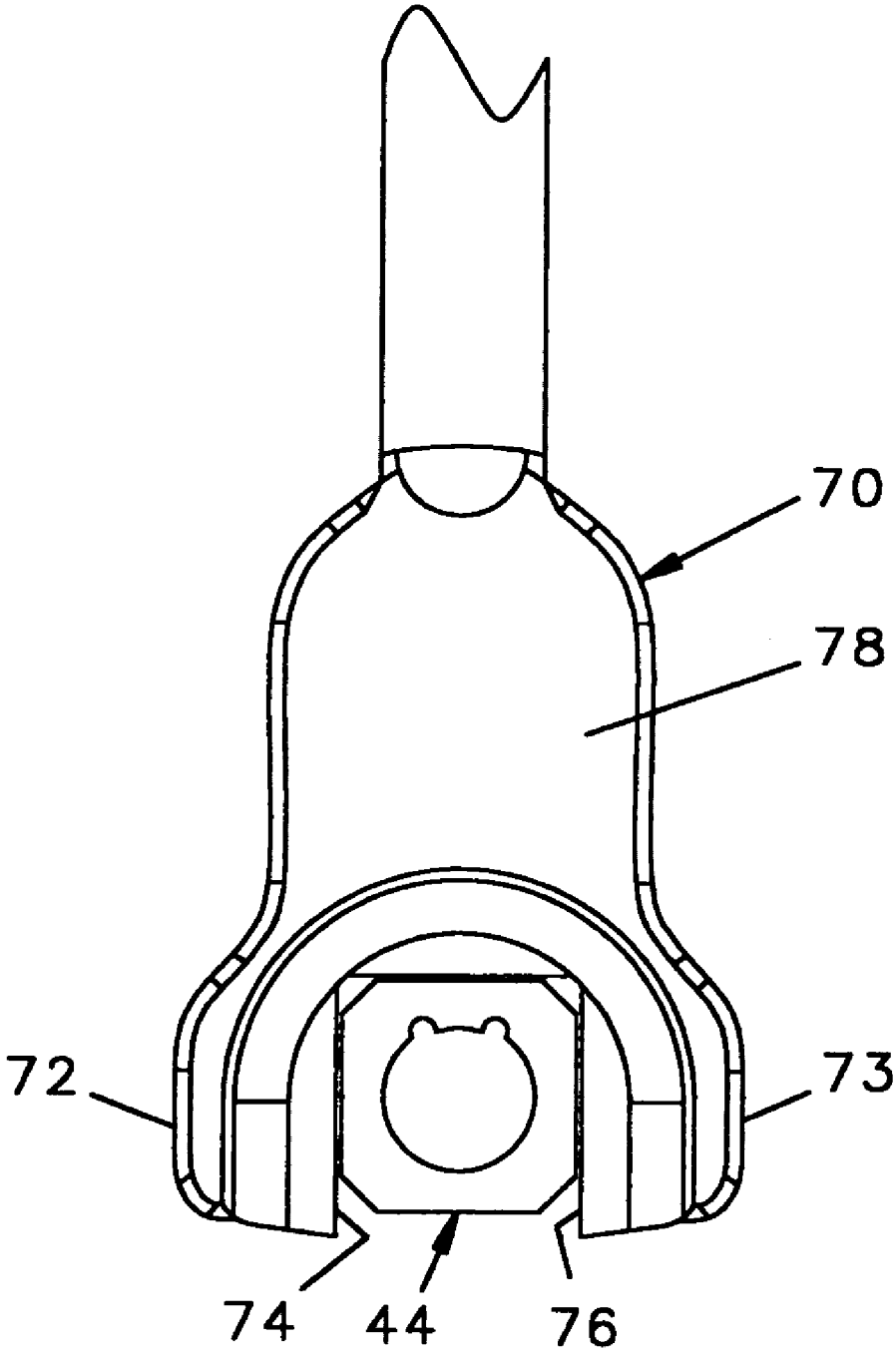
FIG. 6 is a front-elevational view of the working end of an extraction tool for extracting the tool having the wear ring shown in FIG. 2.
Figure 7:
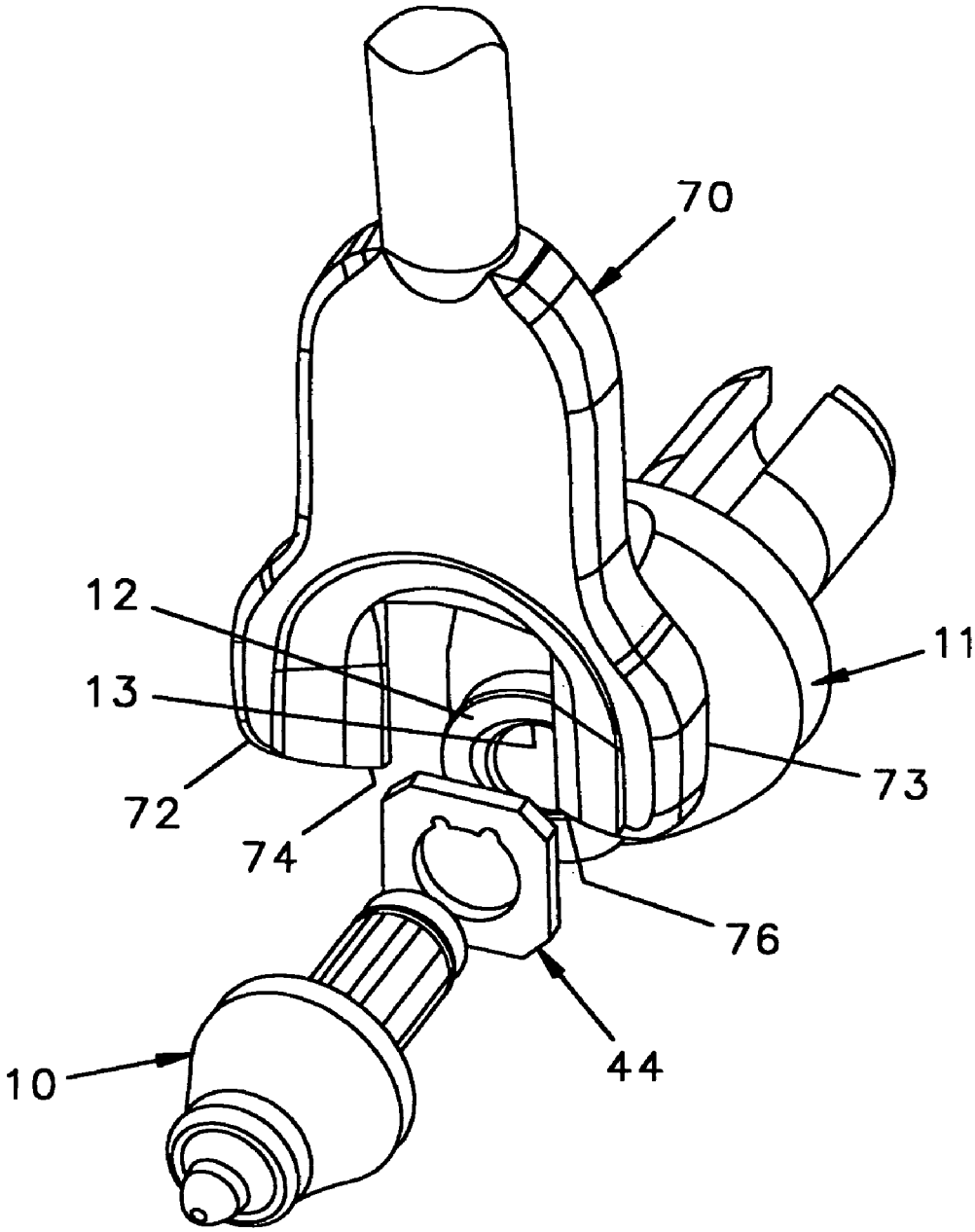
FIG. 7 is an exploded isometric view of the extraction tool shown in FIG. 4 and the tool, tool holder, and wear ring shown in FIGS. 1 and 2.
Figure 8:
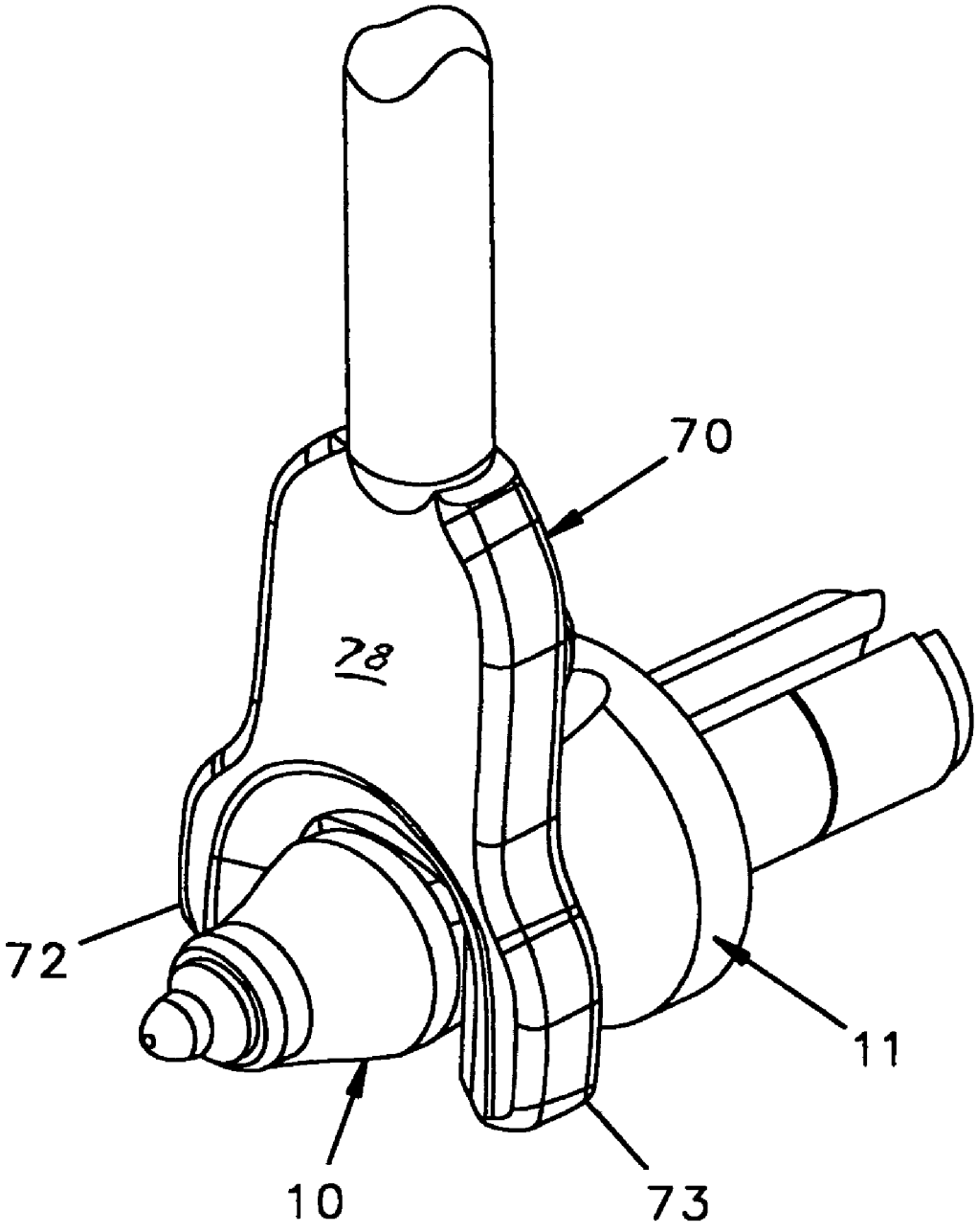
FIG. 8 is an isometric view of the extraction device fitted around a tool and tool holder having a wear ring in accordance with the invention.

Referring to FIGS. 2, 4, 6, 7, and 8, to remove the shank 22 of the tool 10 from the bore 13 of the tool holder 11, an extraction tool 70 is provided having forked end consisting of spaced apart parallel prongs 72, 73. As best shown in FIG. 6, the prongs 72, 73 are spaced apart a distance that is a little greater than the distance 65 (FIG. 4) between the spaced parallel surfaces 47, 51 (FIG. 2) or between surfaces 49, 53 of the wear washer 44. The inwardly directed sides 74, 76 of the prongs 72, 73 respectively are tapered such that the tapered inner sides will fit in the gaps 67, 68 (FIG. 2) adjacent the surfaces 47, 51 of the wear ring 44. The extraction tool 70 includes an impact portion 78 that can be struck by the head of a hammer, not shown, while the prongs 72, 73 are fitted in the gaps 67, 68 to thereby remove the tool 10 from the tool holder 11.

While the present invention has been described as employing a wear ring having a radially inwardly directed projection 60 that engages portions of the compressible sleeve 28 to thereby prevent rotation of the wear ring, the invention may be employed on any rotatable tool having a wear ring between the rear surface of the tool and the forward surface of the wear ring. The configuration of the inner opening of the wear ring is not a necessary element of the invention.

Since the forward surface 12 of the tool holder 11 has not become indented as a result of the repeated insertion of tools 10, the gaps 67, 68 as shown in FIG. 2 do not become reduced and remain sufficiently large to receive the prongs 72, 73 of the extraction tool 70.

Figure 9:
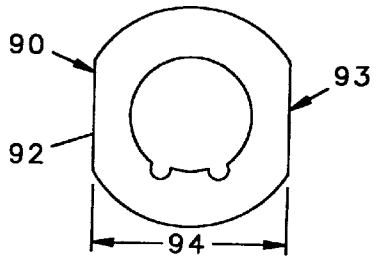
FIG. 9 is a front elevational view of a second embodiment of a wear ring according to the invention.
Figure 11:
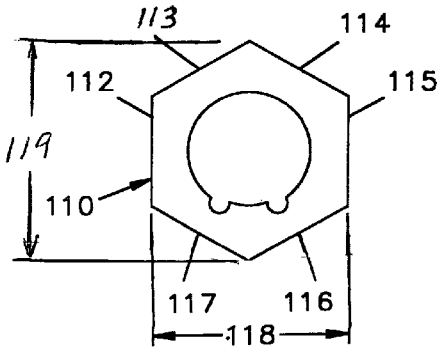
FIG. 11 is a front elevational view of a third embodiment of a wear ring according to the invention.
Figure 12:
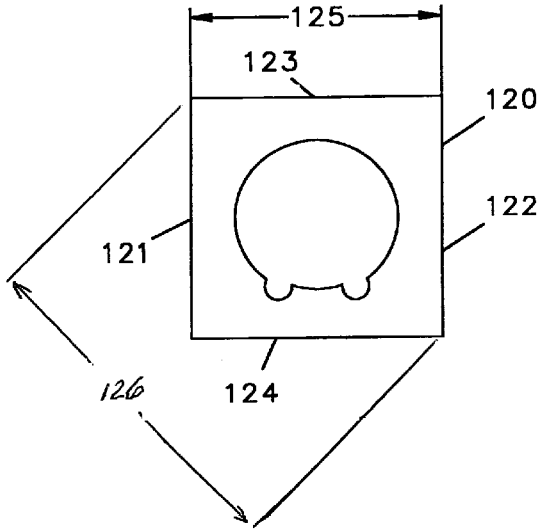
FIG. 12 is a front elevational view of a fourth embodiment of a wear ring according to the invention.

It should be appreciated that the outer surface of the wear ring may have any of a number of configurations as long as the wear ring has a minimum diametric dimension 65 that creates opposing gaps between the rearwardly directed surface 20 of the tool and the forward surface 12 of the tool holder and has a maximum diametric dimension 120 that is at least equal to the diameter 69 of the forward surface 12 of the tool holder 11. Referring to FIG. 9, another embodiment of a wear ring 90 has opposing parallel side surfaces 92, 93 that are spaced apart a distance 94 equal to diameter 65 of wear ring 44. The narrow diameter 94 that will allow gaps between the two surfaces 12, 20 into which the prongs 72, 73 of a removal tool 70 can be inserted. The wear ring 90 also has a maximum outer diameter 95 that is at least equal to the outer diameter 69 of the forward surface 12 of the tool holder 11. Similarly, in FIG. 11, another wear ring 110 has six outer surfaces 112, 113, 114, 115, 116, 117 defining a hexagon with the spacing 118 between parallel surfaces thereof are sized to allow gaps 67, 68 sufficient for use of the tool 70. Wear ring 110 also has a maximum diametric dimension 119 that is at least equal to dimension 69, the diameter of forward surface 12. And, finally, in FIG. 12, a wear ring 120 has two sets of parallel sides 121, 122, and 123, 124 configured into a square with the spacing between parallel sides having a minimum dimension 125 small enough to form adequate gaps 67, 68 to receive the prongs of tool 70, and a maximum dimension 126 at least equal to dimension 69 of the forward surface 12 of the tool holder 11.

While the invention has been described with respect to a single embodiment, it will be appreciated that many modifications and variations may be made without departing from the true spirit and scope of the invention. It is therefore the intent of the appended claims to cover all such modifications and variations which fall within the spirit and scope of the invention.

What is claimed is:

1. The combination comprising:

a tool having a tapered forward cutting end, a rearwardly facing radial flange at a rear of said tapered forward cutting end, said radial flange having a diameter defining a first dimension, and a cylindrical shank extending axially rearward of said radial flange, a tool holder having a forward surface, a cylindrical bore opening in said forward surface, an outer surface intersecting said forward surface wherein diametrically opposing portions of said intersecting surfaces define a second dimension, a wear ring on said shank between said radial flange and said forward surface, said wear ring having a non-circular outer perimeter having a first width defining a third dimension and a second width defining a fourth dimension, said third dimension is less than both said first dimension and said second dimension wherein a spacing remains between a portion of said flange and a portion of said forward surface, said fourth dimension at least equal to said second dimension, a retaining sleeve around said cylindrical shank and within said cylindrical bore for retaining said shank within said bore, and a lock between said wear ring and said sleeve wherein said wear ring is locked against rotation with respect to said forward surface solely by slid sleeve and an orientation of said wear ring with respect to said forward surface is random.

2. The combination of claim 1 and further comprising an extraction tool having a pair of parallel members defining a fork wherein a portion of said parallel member is receivable in said spacing for removing said tool from said tool holder.

3. The combination of claim 1 wherein said outer perimeter includes a pair of parallel opposing end surfaces spaced apart by said third dimension.

4. The tool of claim 3 wherein said outer end further includes a second pair of parallel opposing end surfaces perpendicular to said pair of parallel surfaces, said second pair of parallel opposing end surfaces also spaced apart a distance equal to said third dimension.

5. The combination of claim 3 wherein said outer end further includes a pair of opposing arcuate end surfaces said arcuate end surfaces spaced apart by said fourth dimension.

6. In a tool having a tapered forward cutting end, a rearwardly facing circular radial flange at a rear of said tapered forward cutting end, said radial flange having an outer diameter defining a first dimension, and a cylindrical shank extending axially rearward of said radial flange, said cylindrical shank receivable in a bore of a tool holder having a forward surface with opposing outer end portions defining a second dimension, the improvement comprising a wear ring on said shank, said wear ring having a non-circular outer end, said outer end of said wear ring having a first diameter outer dimension that is less than said first dimension and less than said second dimension wherein said wear ring will provide a space between a portion of said radial flange and a portion of said forward surface when said shank is inserted in said bore, said outer end of said wear ring having a second diameter outer dimension that is at least equal to said second dimension, a retaining sleeve around said shank for retaining said shank in said bore, and a lock between said wear ring and said sleeve wherein said wear ring is locked against rotation with respect to said forward surface solely by said sleeve and an orientation of said wear ring with respect to said forward surface is random.

7. The improvement of claim 6 wherein said outer end includes a pair of parallel opposing end surfaces spaced apart by said third dimension.

8. The improvement of claim 7 wherein said outer end further includes a second pair of parallel opposing end surfaces perpendicular to said pair of parallel surfaces, said second pair of parallel opposing end surfaces also spaced apart a distance equal to said third dimension.

9. The improvement of claim 7 wherein said outer end further includes a pair of opposing arcuate end surfaces said arcuate end surfaces spaced apart by said fourth dimension.

* * * * *